US005403162A

United States Patent [19]

Chen

[11] Patent Number: 5,403,162

[45] Date of Patent: Apr. 4, 1995

[54] FAN TREE

[75] Inventor: Jou H. Chen, Taipei, Taiwan, Prov. of China

[73] Assignee: Collins International Co., Ltd., Fair Lawn, N.J.

[21] Appl. No.: 83,089

[22] Filed: Jun. 25, 1993

[51] Int. Cl.[6] ..... F04D 23/00

[52] U.S. Cl. ..... 416/246; 248/125

[58] Field of Search ..... 416/246, 120; 248/676, 248/125

[56] References Cited

U.S. PATENT DOCUMENTS

| | | | |
|---|---|---|---|
| D. 101,740 | 10/1936 | Kirsch . | |
| D. 311,772 | 10/1990 | Yang . | |
| 576,769 | 2/1897 | Williams . | |
| 816,759 | 4/1906 | Stowe | 416/100 |
| 2,164,608 | 7/1939 | Cornelius | 230/250 |
| 2,626,742 | 1/1953 | Turner | 416/120 |
| 2,981,917 | 4/1961 | Glass | 248/125 |
| 3,185,838 | 5/1965 | Warshawsky | 248/125 |
| 3,200,731 | 8/1965 | Hart, Jr. | 98/1 |
| 3,223,826 | 12/1965 | Macaluso | 219/352 |
| 3,240,925 | 3/1966 | Paschke | 416/5 |
| 3,441,329 | 4/1969 | Solomon | 312/245 |
| 4,240,603 | 12/1980 | Chiarello | 248/125 |
| 4,977,850 | 12/1990 | King | 248/125 |

FOREIGN PATENT DOCUMENTS

| | | | |
|---|---|---|---|
| 476657 | 12/1920 | Germany | 416/100 |

*Primary Examiner*—John T. Kwon
*Attorney, Agent, or Firm*—C. G. Nessler

[57] ABSTRACT

Two oscillating air fan assemblies are attached to arms which are slidable around and along a three piece screwed-together pole. Each fan is adjustable in multiple ways, and can be locked in place for efficiently cooling humans and things. The apparatus is readily disassemblable, for efficient shipping. Each molded plastic arm has holes and a hollow interior with a post through which runs the wire connecting the fan assemblies, so it is adequately secured.

10 Claims, 3 Drawing Sheets

FAN TREE

FIELD OF THE INVENTION

The present invention relates to air distribution fans, in particular to fans mounted on vertical floor stands for cooling humans.

BACKGROUND

Humans have long used artificially induced air flows, to cool themselves during warm weather. Floor and table mounted propellor fans came into widespread use with mass production of fractional horsepower electric motors. By increasing airflow, fans increase evaporative cooling from the body skin, thereby cooling a person. They also may circulate comparatively cool air to warm areas. Fans are attractive to consumers, compared to, or in addition to, air conditioners, because they are of comparatively lower cost.

Of course, the further the fan from the person being cooled, the less the effectiveness of cooling. On the other hand if the fan is too small or too close—or if air only comes from one direction—then the extent of cooling is limited, particularly when one's whole body—or more than one person—requires cooling.

It has long been common to have fans mounted on poles which are adjustable for height and angle in vertical and horizontal planes to aim the air flow. See for instance U.S. Design Pat. No. 311,772 to Yang, U.S. Pat. No. 3,200,731 to Hart, Jr., and U.S. Pat. No. 2,164,608 to Cornelius. Generally, floor mounted pole fans have tended to be physically large, for blowing air over large areas. If the fan air flow is made larger, cost, power consumption, and noise rise. In both pole and table top fans, it has long been known to have mechanisms that cause the fan assembly to oscillate from side-to-side to widen distribution of air. But, of course, the more complicated the aiming or adjusting mechanisms, and the more the degrees of freedom, the more costly the devices may be to the consumer.

Another consideration for mass marketing of consumer goods is that a fan be susceptible to being shipped disassembled, or "knocked-down" in a compact box, provided the parts may be easily assembled by the consumer.

Thus, there is a continuing need for resolving the competing needs for a fan apparatus so it is effective in achieving the desired purposes of cooling and moving air in different directions, but at the same time economic to manufacture and capable of being shipped in "knocked-down" condition.

SUMMARY

An object of the invention is to provide fan apparatus which can provide airflows aimed in multiple different directions and from different heights. Another object of the invention is to provide a product which is straightforward in design and suitable for being shipped in knocked-down state and easily assembled without tools.

According to the invention air distribution apparatus is comprised of a base, a pole attached to the base, and at least two arms mounted on the pole, each arm supporting a fan assembly. The arms are rotationally movable both around the pole and along its length; they are releasably fastened in a desired position. Each fan assembly is attached to an arm at a pivotable connection, for example a combination of pinned clevis and tab, to enable adjustment of the fan assembly in a plane containing the length of the arm, that is, so air can be directed up and down. The fan assemblies are interconnected by a wire which permits independent adjustment of the arms relative to one another.

In further accord with the invention, a preferred embodiment includes a fan assembly with integral gear drive, to enable oscillation of the motor laterally with respect to the length of the arm, i.e., from side to side. Another preferred embodiment includes a wire that is an extensible spiraled cable, the ends of which run through tubular portions of arms, where they are secured against external forces by a combination of tortuous path and wrapping around an internal post. Preferably, the pole supporting the arm is round and smooth, being made from multiple screwed together parts; each arm is clamped to the pole by means of a finger screw engaged in captured threaded plate, the screw pressing a friction pressure pad against the pole. The arms thus readily slip off and on the end of the pole.

The invention facilitates easy assembly and independent adjustment of air flow. Air may be aimed to converge from different directions on the person or thing to be cooled, for maximum effectiveness. The invention is also easily fabricated at low cost and assembles into a sturdy unit. The foregoing and other objects, features and advantages of the invention will become more apparent from the following description of the best mode of the invention and accompanying drawings.

DESCRIPTION

The invention is described in terms of a floor-mounted metal pole holding two adjustable fan assemblies. Many of the parts are made of injection molded plastic. It will be understood that the invention encompasses other materials of construction and units having more than two fans. One embodiment of the invention is intended to be sold under the commercial trademark TreeFan, having like some other older domestic furnishings some character like that of a natural tree.

Figure 1:
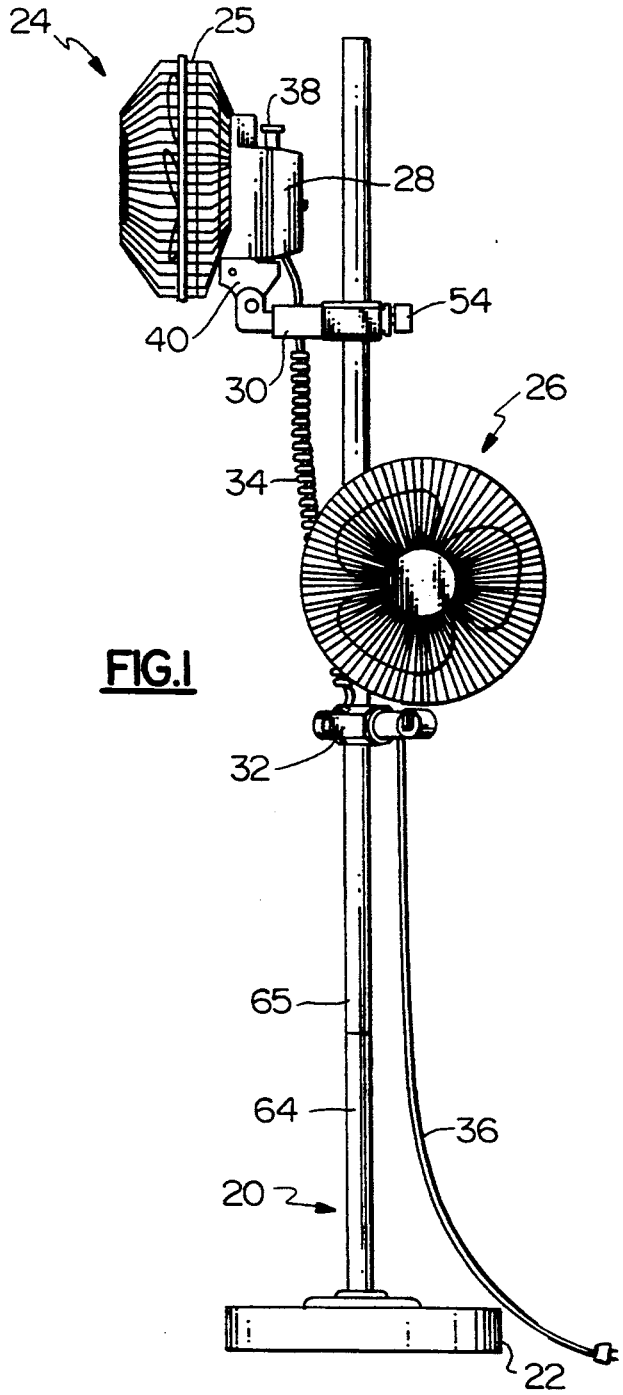
FIG. 1 is an elevation view of a fan tree, showing two adjustable fan assemblies supported on arms attached to a pole supported off a base.

FIG. 1 shows in elevation a two-fan assembly. A three piece hollow round pole 20 is screwed into a comparatively heavy metal base 22. Two fan assemblies, 24, 26, are mounted on the pole, one above the other, by arms 30, 32 clamped to the pole. The typical upper fan assembly is comprised of a housing 28 which contains an electric motor. A propeller fan is mounted on the driven shaft of the motor and the fan is surrounded by a safety cage 25. A spiraled electric conductor, wire 34, interconnects the fan assemblies, running in part generally parallel to the pole in the vertical space between the assemblies. A power feed line 36 runs from the lower motor toward the base and floor, for connection to a domestic electric power source. Suitable electric connections are made so that the motors are wired in parallel.

Figure 2:
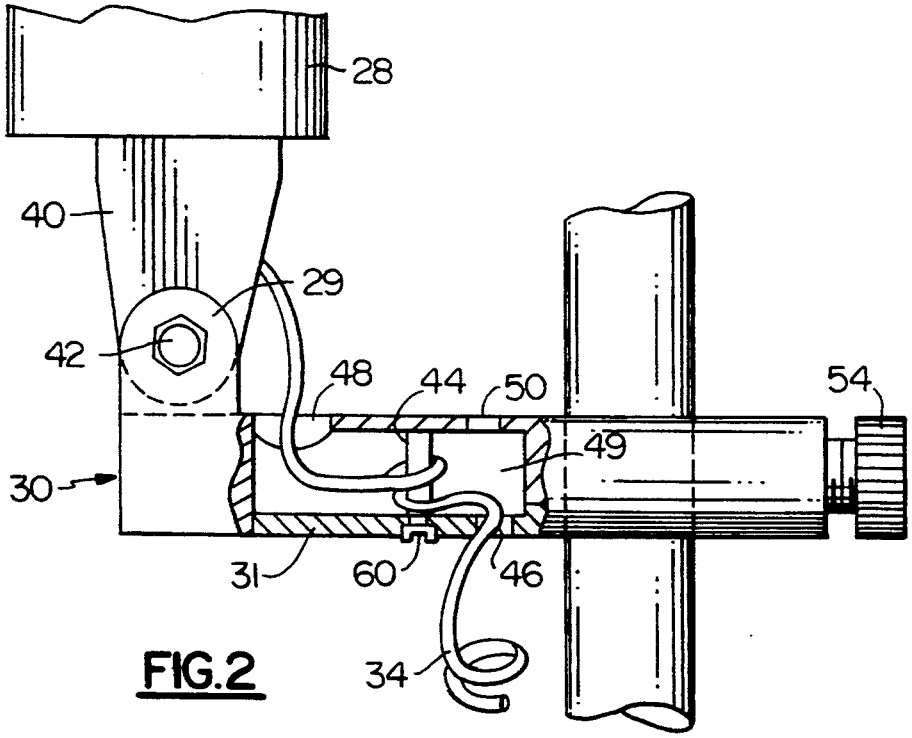
FIG. 2 is a detail view of the upper arm of FIG. 1.

Referring to FIG. 1 and Fig.2, the typical arm 30 has a round hole through which the pole passes, and a finger screw, e.g., 54, forces a pressure pad against the pole inside the arm, to hold the arm in the desired vertical and rotational position, resisting vibrations and other forces.

The typical upper and lower fan assemblies are of an essential kind that is commercially familiar. On the rear of the housing of each motor is an unshown switch, so that the fan can be set at one of two speeds or turned off. Within each fan motor housing is a commercial gear drive mechanism driven by the fan motor. When engaged by means of a button 38 projecting upwardly from the housing, the mechanism causes the housing to rotate in oscillatory fashion in the plane substantially parallel to the longitudinal axis of the pin 42. For example, the fan 26 in FIG. 1 rotates left and right along an arc of about 90 degrees; and fan 24 rotates correspondingly.

As further shown by FIG. 2, a typical fan assembly and arm combination includes a tab 40 that projects downwardly from the typical housing 28. The fan assembly is thus pivotally connected by the tab to a mating part, projection 29—a clevis—at the end of arm 30. The pivotal connection, held together and frictionally tightened by a clamping pin 42, enables rotation of the housing in a plane which contains the length of the arm, i.e., to angle up and down in the plane of the paper as shown in FIG. 1 and 2.

Figure 4:
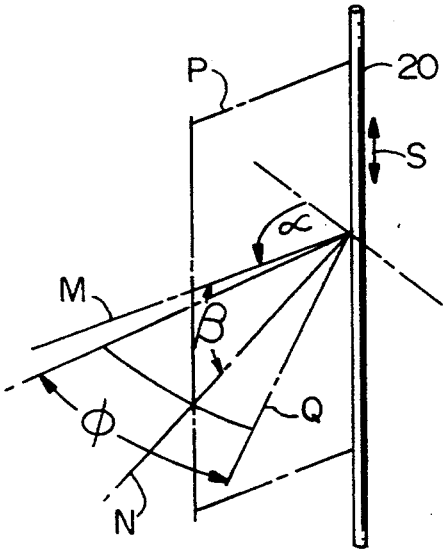
FIG. 4 illustrates the geometry of adjustments of each fan assembly.

Thus, the combination of arm, housing, rotatable pivot connection and housing gear mechanism provide means for the following motions, as illustrated by FIG. 4: vertical motion S along the length of the pole; rotation in the horizontal plane to an angle $\propto$ from an arbitrary starting direction, to point along bearing line M; angling up or down an angle $\beta$ in vertical plane P of the length axis of the pole and line M, to point along line N; oscillating over an angle $\Phi$ in plane Q which contains line N and is perpendicular to plane P. As such, the apparatus, through the combination of the two fans, will effectively and conveniently provide air to different locations simultaneously; or, along different vectors at compound angles to each other, to the same location.

The other Figures provide more details of the invention. Since it is an aim to adjust the position of the fans independently, and perhaps even while running, the wire connecting the fans enables such, but at the same time it is properly secured against external forces. Thus, the wire 34 connecting the two motors is for the most part a commercial spiralled cord which is by its nature extensible. Obviously, a straight wire would work as well but be less neat in appearance. As shown by FIG. 2 the wire is secured within the arm 30, so that any inadvertent force on the wire hanging between the arms is not transmitted to the housing 28. Thus, the arm 30, has a tubular portion with a hollow interior 49, within which is a transverse post 44. Three holes 46, 48, 50 thought the walls of the tubular portion communicate the interior hollow with the exterior. The wire 34 runs through lower hole 46, wraps around post 44, runs out the hole 48, then through a hole or space in the tab—continuing on through the housing 28 and to the electric motor. The combination of tortuous path and engagement with the post secures the wire in place.

Figure 3:
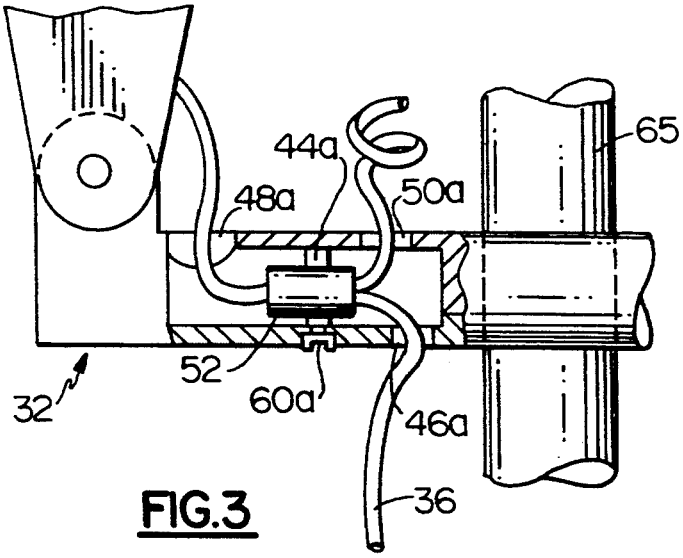
FIG. 3 is a detail view of the lower arm of FIG. 1.

FIG. 3 shows the lower arm 32 which has parts corresponding in configuration to the upper arm, as indicated by the numbers with suffixes. Wire 34 from the upper arm enters the lower arm interior through top hole 50*a;* the wire 36, from the power source, enters through bottom hole 46*a*. The wires connect within a connector package 52 contained in the hollow of the arm interior; they are also engaged by the post 44*a*.

Figure 5:
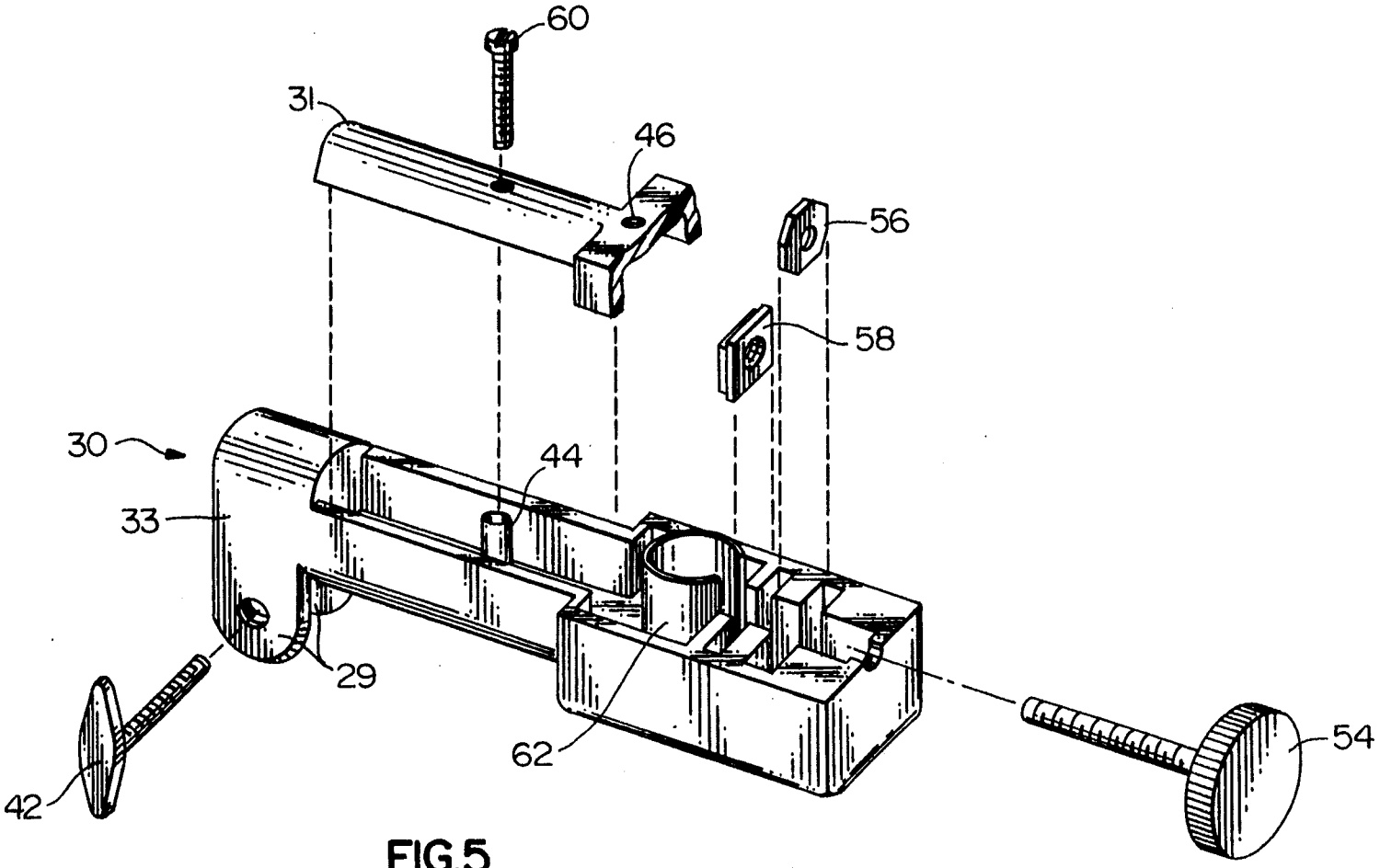
FIG. 5 is an exploded view of a preferred arm construction.

FIG. 5 shows in exploded view the typical molded plastic arm 30; it is upside down compared to its orientation in FIG. 1 and 2. Thus, the transversely projecting clevis 29 points downwardly. The clamping pin 42 is a plastic headed finger screw which engages a nut recessed in a small cavity on the opposite side of the clevis, as visible in FIG. 2.

The arm is made from two major pieces: the arm body 33 and a detachable cover part 31, partially shown. The pieces are held together by screw 60 which threads into a hollow in post 44. An integral sleeve 62 is shaped to fit the pole on which the arm mounts. The means for clamping the arm to the pole is comprised of a finger screw assembly having three essential elements: A plastic headed finger screw 54 passes through a nut 56 or other threaded plate that is captured within slots of the arm; and, a flanged plastic pressure pad 5 having a small recess—loosely captured within the arm body—is thrust by screw 54 toward the pole where it runs through the arm. Thus, the assembled arm can be removed from the end of the pole, and it can be readily put back on the pole at the time of assembly.

Figure 6:
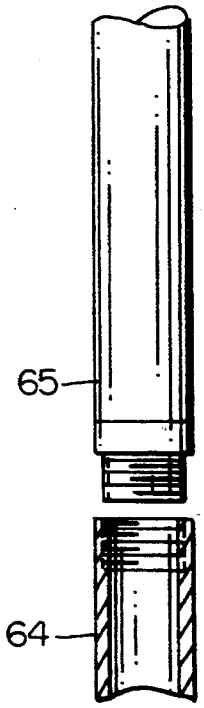
FIG. 6 shows how multi-piece poles screw together.

FIG. 6 details the pole construction. There are three round tubular pieces. The upper piece and lower most piece 64 have internal threads; the middle part 65 has opposing mating male threads. Base 22 has a male thread to receive the lower piece. All pole piece ends have sharp shoulders. The design not only provides a secure assembly, but provides a smooth surface for sliding of the arms along the length of the pole. A typical pole will be comprised of 3 pieces having a total length of 125 cm. The pole construction thus combines with the arm construction to make the device suitable for easy knock-down and consumer assembly, while at the same time providing a stable and sturdy device.

In the generality of the invention, more than two arms and fan assemblies may be used. Of course, the arms do not need to be identical to each other. Other cross section of poles may be used, for instance square or hexagonal, although the relative horizontal plane rotational adjustment will then only be achieved by removing an arm from the end of the pole or by more complex construction. Other, often more complex, ways of adjusting in the horizontal plane may be used. For instance, a rotatable collar might be included in the arm where the pole attaches; or segments of the pole may rotate. While the multiple piece pole described above is preferred, other known single and multiple piece constructions may be used.

While a propeller fan mounted on the output shaft of a motor is preferred for simplicity and low cost, other substitutional means for directionally inducing air flow by a motor will be within the scope of the invention. Other less advantageous ways of releasably clamping an arm to the pole may be employed within the scope of the invention. For instance, pins and holes may be used; and a split collar or other circumscribing clamp may be used.

Other connections between the arm and the housing than the preferred clevis and tab may be used; the combination of projection, tab and clamping pin, as used herein, is intended to generally suggest and encompass other equivalent constructions by which a pivotable connection is made between the housing and arm.

While the transverse post in the hollow of an arm is preferred to aid in securing a wire, other mechanical attachments to secure a wire within the hollow will be within the generality of the invention.

Although only the preferred embodiment has been described with some alternatives, it will be understood that further changes in form and detail may be made without departing from the spirit and scope of the claimed invention.

I claim:

1. Apparatus for distribution of air comprised of:

a base, for supporting a pole and resting on a floor;

a pole, having a length, attached to and projecting with its length from the base;

at least two arms mounted on the pole, one above the other; each arm having a length and projecting transversely from the pole; each arm having means for pivotable attachment of a housing; each arm rotatable about the pole in a plane perpendicular thereto and slidable along the pole length; each arm having a releasable fastener, for securing each arm to the pole in a desired position;

air blowing assemblies, equal in number to the number of arms, each air blowing assembly having a housing containing an electric motor driving means for inducing airflow, and having means for pivotable attachment to an arm;

each arm pivotably connected to an airblowing assembly at the respective pivotable attachment means thereof, to form for each a pivotable joint enabling rotation of the air blowing assembly in a plane containing the length of the arm;

means incorporated into each pivotable joint for tightening each pivotable joint and stopping rotation thereof;

a wire, electrically interconnecting two of the air blowing assemblies in serial fashion, in part hanging in the vertical space between the arms and generally running along the length of the pole, to enable independent adjustment of the arms relative to one another; and an arm having a tubular portion; the tubular portion having a hollow interior connected to the exterior of the arm by at least two spaced apart holes; the wire running in a first hole, along the arm hollow interior, and out a second hole, toward the housing of the air blowing assembly connected to the arm.

2. The apparatus of claim 1 wherein the means for inducing flow of air comprises a fan assembly having a propellor, the assembly having integral means for rotatably directing air flow in a plane parallel to a plane containing the pivot joint.

3. The apparatus of claim 1 characterized by a post running transverse to the length of the arm within the hollow interior of the tubular portion, and a wire engaged with the post.

4. The apparatus of claim 1 characterized by a round pole;

an arm having a hole shaped to receive the pole, and having a hollow interior portion, and having a releasable fastener comprised of a finger screw threaded into the arm;

a pressure pad captured within the hollow arm interior proximate to the hole; and the screw thrusting the pad toward the hole where the pole is received.

5. The apparatus of claim 1 characterized by a wire which is an extensible spiral cord.

6. The apparatus of claim 1 characterized by a round pole comprised of multiple pieces, the pieces shaped to serially attach each to the other as an assembly to form a pole with a smooth exterior for sliding of an arm therealong.

7. The apparatus of claim 6 characterized by multiple sharp shouldered pieces which screw together.

8. The apparatus of claim 1 characterized by a pole and an arm having a hole shaped to receive the pole; the arm comprised of a body with an open cavity;

a closure fastened to the body, to form with a portion of the body cavity a tubular portion;

the releasable fastener extending along the length of the arm within said arm tubular portion;

said fastener comprised of a nut captured within the body, a finger screw threaded through the nut and extending beyond the end of the body; and, a pressure pad captured loosely within the arm adjacent said arm hole, for contacting the pole;

wherein, advancing of the finger screw thrusts the pad against the pole to frictionally lock in position the arm relative to the pole.

9. The apparatus of claim 8 characterized by a pole having a round cross section and an arm with a corresponding round hole.

10. Apparatus for distribution of air adapted for knock-down and easy assembly, comprised of:

a base, for receiving and supporting a pole by resting on a floor;

a round cross section pole, attached to and projecting along a pole length from the base, the pole comprised of at least two screwed-together pieces;

two arms mounted on the pole, one above the other; each arm projecting transversely from the pole along an arm length; each arm rotatable about the pole in a plane perpendicular thereto and slidable along the pole length; each arm having a round hole in which the pole is positioned;

a clevis at the end of the arm length and away from the round hole, for pivotable attachment of a fan assembly housing;

a finger screw means for releasably clamping the arm to the pole;

a tubular portion with a hollow interior, the hollow interior connected to the exterior by at least two spaced apart holes; and, means for engaging a wire to the arm within the hollow interior;

two fan assemblies, for inducing air flow, each assembly having a housing containing an electric motor driving a propellor fan, and a tab on the housing for pivotable attachment of the assembly to an arm clevis;

each arm clevis having the tab of the housing of a fan assembly connected thereto, to thereby comprise a pivot joint and enable rotation of the fan assembly in a plane containing the length of the arm;

a clamping pin at the pivot joint, for releasably tightening the pivot joint and for securing the fan in a desired orientation;

a wire, electrically interconnecting the fan assemblies in serial fashion, in part hanging in the vertical space between the arms and generally running along the length of the pole, the wire enabling independent adjustment of the arms about and along the pole relative to one another; and, the wire running from the fan assembly attached to a first arm and then into a first hole of the first arm, along the first arm tubular interior where it is engaged with the means for engaging therein, then out a second hole of the first arm, through the vertical space between the arms, into a first hole of the second arm, along the second arm tubular interior where it is engaged with the means for engaging therein, out a second hole of the second arm and to the fan assembly attached to the second arm; the path of the wire through the interior hollows and engagement with the means for engaging providing resistance to any external force on the wire.

* * * * *